US009044787B1

(12) United States Patent
Stewart

(10) Patent No.: US 9,044,787 B1
(45) Date of Patent: Jun. 2, 2015

(54) AUTOMATIC SCRATCH-OFF MATERIAL REMOVAL DEVICE

(76) Inventor: Conrad Stewart, West Hempstead, NY (US)

( * ) Notice: Subject to any disclaimer, the term of this patent is extended or adjusted under 35 U.S.C. 154(b) by 1123 days.

(21) Appl. No.: 12/823,257

(22) Filed: Jun. 25, 2010

(51) Int. Cl.
*A46B 13/02* (2006.01)
*B08B 1/00* (2006.01)
*A63F 3/06* (2006.01)

(52) U.S. Cl.
CPC *B08B 1/002* (2013.01); *A63F 3/068* (2013.01)

(58) Field of Classification Search
CPC ..... A63F 3/068; B08B 1/002
USPC ..... 15/21.1, 40, 77, 88.2, 88.3
See application file for complete search history.

(56) References Cited

U.S. PATENT DOCUMENTS 4,777,693 A 10/1988 Diba et al.
4,793,061 A 12/1988 Rizzo, Jr.
5,127,720 A 7/1992 Shultz
5,355,543 A * 10/1994 Cameron et al. ..... 15/93.1
5,402,549 A * 4/1995 Forrest ..... 15/88.3
5,577,287 A * 11/1996 Olson ..... 15/93.1
5,615,441 A 4/1997 Savini
5,907,882 A * 6/1999 Tyree ..... 15/77
7,607,193 B1 * 10/2009 Franklin ..... 15/236.01
8,191,195 B2 * 6/2012 Nelson ..... 15/111
2004/0007653 A1 1/2004 Zesk
2006/0278540 A1 * 12/2006 Schacht ..... 206/39

* cited by examiner

*Primary Examiner* — Monica Carter
*Assistant Examiner* — Michael Jennings
(74) *Attorney, Agent, or Firm* — Robert C. Montgomery; Montgomery Patent & Design, LP

(57) ABSTRACT

An automatic scratch-off material removing device for lottery tickets comprises an enclosure, a power source, a brush, and a retention tray. The enclosure comprises a durable housing for the various components of the device having a loading slot where a user may insert a lottery ticket. The power source comprises a replaceable battery which is housed inside the enclosure and accessed via a removable cover located within a bottom surface of the enclosure. The brush comprises an electric rotating brush system which removes the scratch-off material from the ticket via a brush assembly. The excess scratch-off material falls into the retention tray, which is slidably removable from a rear portion of the enclosure.

16 Claims, 7 Drawing Sheets

AUTOMATIC SCRATCH-OFF MATERIAL REMOVAL DEVICE

RELATED APPLICATIONS

The present invention was first described in a notarized Official Record of Invention on Sep. 28, 2009, that is on file at the offices of Montgomery Patent and Design, LLC, the entire disclosures of which are incorporated herein by reference.

FIELD OF THE INVENTION

The present invention relates generally to scratch-off material removal devices, and in particular, to an automatic scratch-off material removal device for use on scratchcard game tickets.

BACKGROUND OF THE INVENTION

Just about everyone has played an instant lottery ticket at one time or another. The excitement of finding out whether or not you have a winning ticket is a pleasure enjoyed by many. However, such a hobby does come with a few drawbacks. It is often times difficult to locate an object that can be used to remove the scratch-off coating off of the ticket. Typically nearby objects are used as makeshift scrapers, such as fingernails, coins, or writing instruments. However, these objects do an incomplete job and have a tendency to damage the ticket. It is also hard to find a suitable surface upon which to place the ticket while it is being scratched. Hands or seat cushions do not form a firm stable surface and bars and countertops can be wet or dirty and as such may lead to ticket damage and possible ticket invalidation. Additionally, the ticket shavings often soil clothing and floors as they fall off. Finally, scratching off the tickets takes time and many people are just too excited to wait any longer than is necessary and others have physical impairments which may make manual scratching off of the coating difficult or impossible.

Various scraping devices for use with lottery scratch-off tickets are known, each attempting to provide solutions to these problems and disadvantages. These devices vary in function and use, examples of which can be seen by reference to several U.S. Patents. One (1) solution includes improved handheld scrapers as seen in U.S. Pat. No. 5,615,441, issued in the name of Salvini, which discloses a lottery ticket scraper and brush device.

Other solutions provide manual scraper devices such as those seen in U.S. Pat. No. 4,777,693, issued in the name of Diba et al., which discloses a scraper carrying case container for lottery tickets including a carrier which holds a manual scraper for the removal of the scratch-off coating layer. U.S. Pat. No. 4,793,061, issued in the name of Rizzo, Jr., discloses a ticket scraper having an edged scraper element which removes the coating layer as the ticket passes through a slot and a manual pressure is applied to the ticket surface. U.S. Pat. No. 5,127,720, issued in the name of Shultz, discloses a lottery ticket tray including a smooth ticket support surface and a removable drawer which collects the ticket scrapings. U.S. Pat. No. 5,577,287, issued in the name of Olson, discloses a lottery ticket scraper having a housing with a spring loaded scraper blade which forcibly engages the ticket surface as the ticket passed through the device.

Other devices attempt to provide an automatic means of removal of the coating as can be seen in U.S. Pat. No. 5,355,543, issued in the name of Cameron et al., which discloses a lottery card scraper apparatus including a housing with a motor driven internal helical blade arranged to remove the coating as the ticket passes through the housing. U.S. Pat. No. 5,402,549, issued in the name of Forrest, discloses a coin operated ticket scraper having a motor driven scraping brush for removal of the coating. U.S. Pat. No. 5,907,882, issued in the name of Tyree, describes a lottery ticket scratch off device including a housing with an internal roller and scratching brush which are driven by a motor and a gear train which removes the coating as the ticket passed through the housing.

While these devices may accomplish their specific intended purpose, each suffers from one (1) or more disadvantage or deficiency with respect to design, function, or effectiveness. Accordingly, there is a need for a means by which instant lottery players can enjoy the game without the disadvantages described. The development of the present invention substantially departs from the conventional solutions and in doing so fulfills this need.

SUMMARY OF THE INVENTION

In view of the foregoing references, the inventor recognized the aforementioned inherent problems and lack in the art and observed that there is a need for tool for effectively and efficiently removing the opaque substance coating from the surface of a scratch off instant game lottery ticket or similar game piece. Thus, an object of the present invention is to solve the aforementioned disadvantages and provide for this need.

Another object of the present invention is to provide a device which increases the speed with which the ticket coating is removed.

Yet another object of the present invention is to provide a device which eliminates the mess associated with the coating scrapings.

Yet another object of the present invention is to provide a device which can be used with any type of size of scratchcard game piece.

Yet still another object of the present invention is to provide a device which is simple and intuitive to use with little to no training.

Yet still another object of the present invention is to provide a device which is durable and economical to manufacture.

One (1) or more of these and other objects of the invention are achieved by providing an automatic scratch-off material removal device comprising an enclosure a generally rectangular enclosure defining an interior portion. An elongated slot is longitudinally disposed along a central position in an upper panel of the enclosure for insertingly receiving the game piece and for providing access to the interior portion. An elongated cylindrical brush body having a brush axle and plurality of rigid bristles is provided adjacent to the slot for removal of the scratch-off coating. A motor having a motor housing affixed to a lateral side panel and a motor shaft extending from the motor is rigidly connected to the brush axle for rotating the brush body. A generally "L"-shaped guard is affixed between opposing lateral side panels and positioned next tot to the brush body for supporting the game piece. A gap is defined between the brush body and the guard for receiving the game piece and positioning the game piece in forced contact with the brush bristles. A collection tray is removably connected within the enclosure and positioned below the brush body for collecting the scratch-off coating scrapings. A removable battery provides a supply of power to the motor and a switch is mounted to an exterior of the enclosure for controlling the supply of power to the motor.

In at least one (1) embodiment of the invention, the device provides the device a magnifying lens hingedly attached to the upper panel of the enclosure nest to the slot. The magnifying lens is capable of being hingedly closed to cover the slot or is capable of being hingedly open to provide a magnified image of the game piece.

Furthermore, the described features and advantages of the invention may be combined in various manners and embodiments as one skilled in the relevant art will recognize. The invention can be practiced without one or more of the features and advantages described in a particular embodiment.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
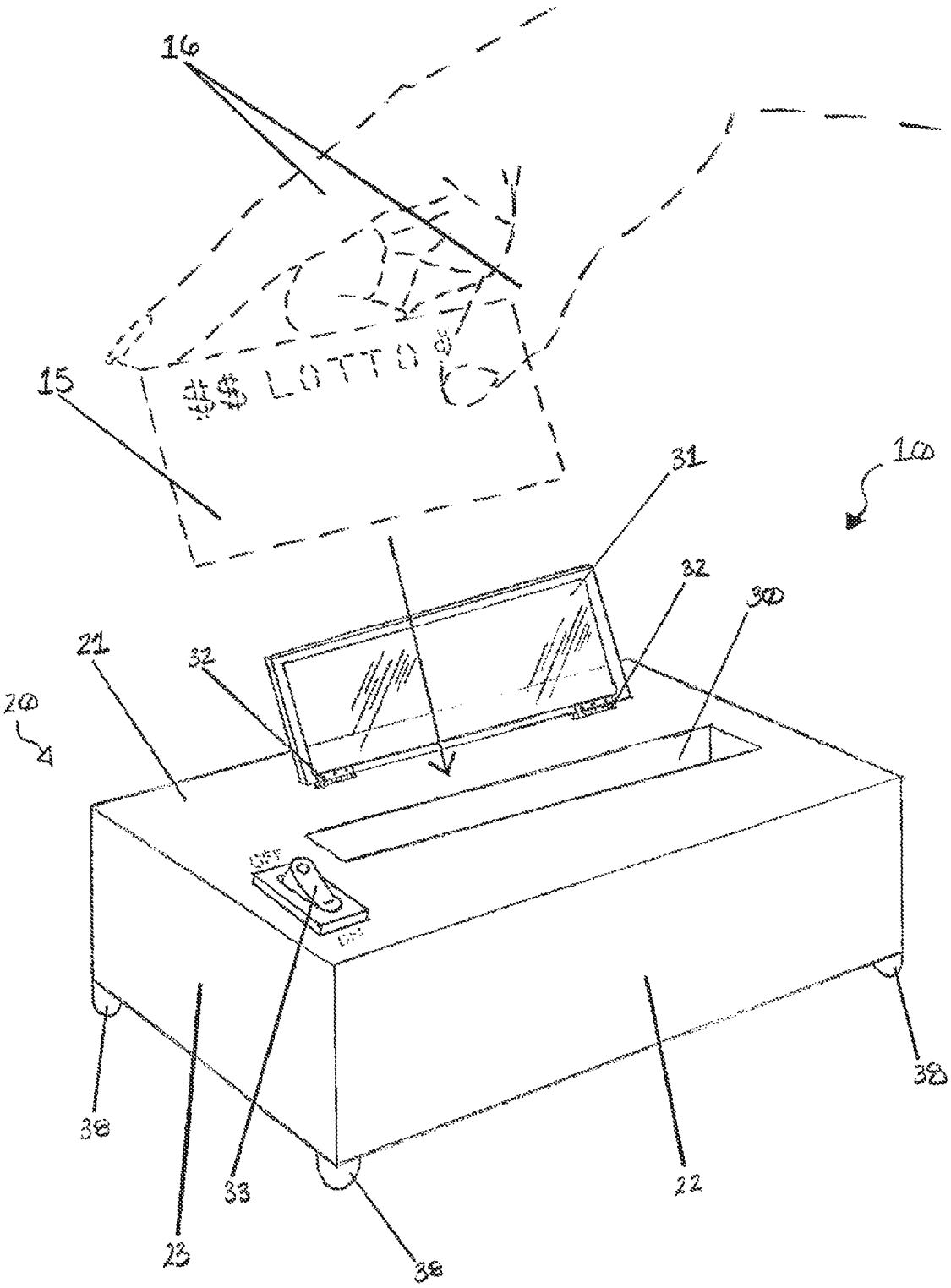
FIG. 1 is an environmental view of an automatic scratch-off material removal device 10, according to a preferred embodiment of the present invention.

10 automatic scratch-off material removal device
15 lottery ticket
16 hand
20 enclosure
21 upper panel
22 front panel
23 side panel
24 rear panel
25 lower panel
26 interior portion
30 slot
31 magnifying glass
32 hinge
33 switch
34 locking tab
35*a* residue access compartment
35*b* collection tray
36 battery compartment
37 battery
38 foot
39 notch
40 scratch-off mechanism
41 brush
42 brush axle
43 brush cap
44 guard
45 guard lip
46 gap
47 reservoir platform
50 motor
51 motor shaft
55 electric wiring

DETAILED DESCRIPTION OF THE PREFERRED EMBODIMENT

The best mode for carrying out the invention is presented in terms of its preferred embodiment, herein depicted within FIGS. 1 through 7. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an automatic scratch-off material removal device (herein described as the "device") 10, which provides a means for removing the opaque substance coating on an instant lottery ticket 15 in lieu of conventional methods such as scratching off with a coin on a rigid surface. The device 10 generally comprises an enclosure 20, a magnifying glass 31, a scratch-off mechanism 40, and a means to collect and retain the removed coating residue. The device 10 enables a user to automatically remove the coating on the lottery ticket 15 in order to reveal the concealed information on the lottery ticket 15 in an efficient and quick manner.

Referring now to FIG. 1, an environmental view of the device 10, according to the preferred embodiment of the present invention, is disclosed. The device 10 comprises an enclosure 20 which provides a housing means to several internal mechanisms and a collecting and retaining means to the removed coating residue. The enclosure 20 comprises features such as an upper panel 21, a front panel 22, a pair of lateral side panels 23, a rear panel 24, and a lower panel 25. The enclosure 20 is approximately ten (10) inches wide, two-and-a-half (2½) inches high, and five (5) inches deep, yet other dimensions may be utilized without limiting the scope of the device 10. The enclosure 20 is preferably fabricated from materials such as, but not limited to: plastic, metal, or the like.

The upper panel 21 of the enclosure 20 comprises a slot 30 which provides an opening for the user to insert the lottery ticket 15. In use, the user grasps the lottery ticket 15 with their hand 16 and inserts the lottery ticket 15 into the slot 30 with the front of the lottery ticket 15 facing the front panel 22. The lottery ticket 15 is engaged by a scratch-off mechanism 40 (see FIG. 4) to remove the coating and reveal the concealed information. The slot 30 comprises dimensions to correspond to various sized lottery tickets 15. The slot 30 is located at an intermediate position on the upper panel 21.

The upper panel 21 also comprises a magnifying glass 31 to produce a magnified image of the lottery ticket 15 to view various sized printing on the lottery ticket 15 as desired. In use, the lottery ticket 15 is placed behind the magnifying glass 31 for viewing. When the magnifying glass 31 is in a downward position the magnifying glass 31 prohibits debris from entering the slot 30. The magnifying glass 31 is hingedly attached to the upper surface 21 by a pair of hinges 32 which are located on a lateral edge of the magnifying glass 31. The hinges 32 enable the magnifying glass 31 to be rotated downwardly against the upper surface 21 when not in use, thereby protecting the magnifying glass 31 from becoming damaged. The magnifying glass 31 is located adjacent to the slot 30 in a parallel orientation.

Figure 4:
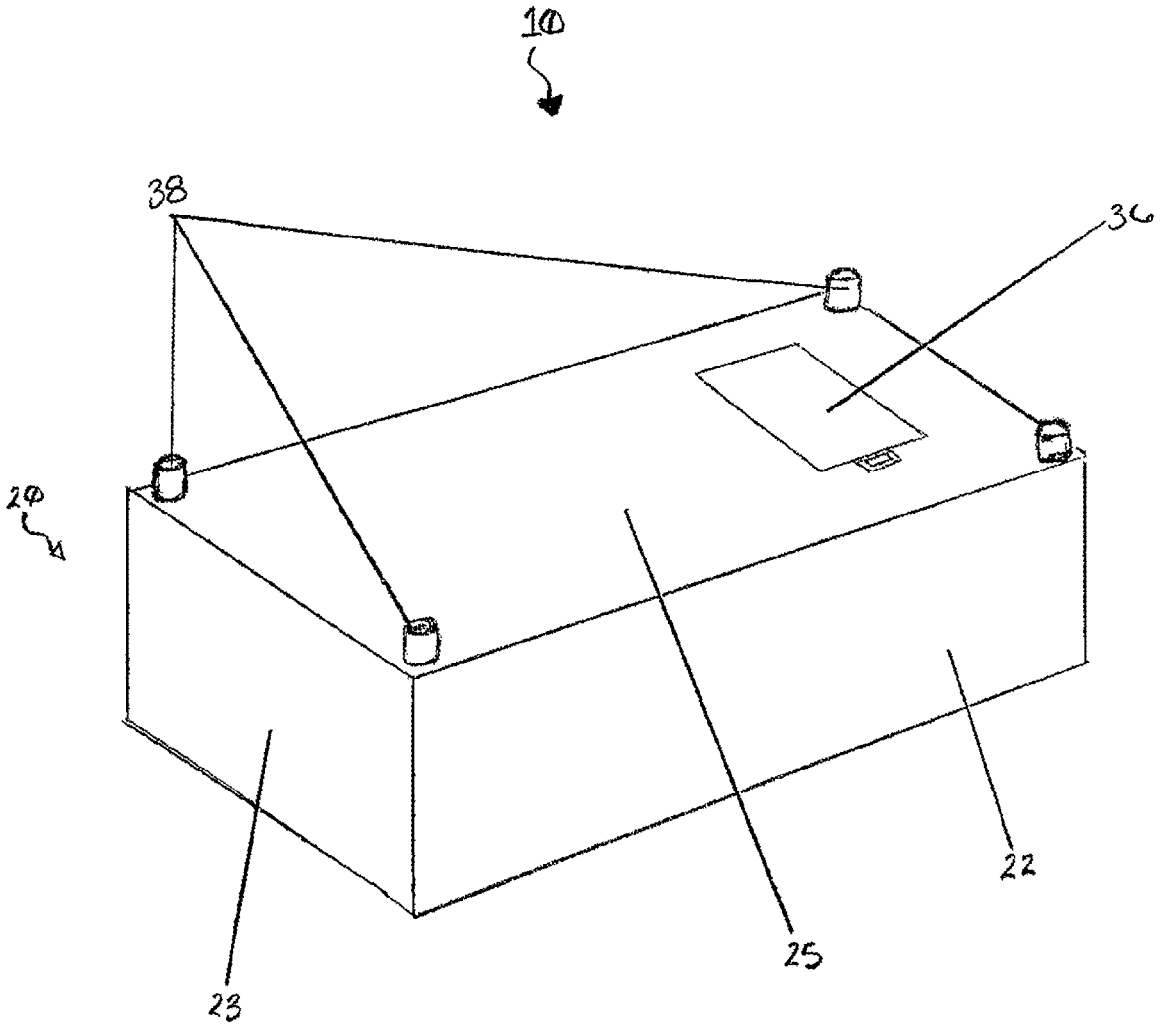
FIG. 4 is an underside perspective view of the automatic scratch-off material removal device for a lottery ticket 10, according to a preferred embodiment of the present invention.

The upper panel 21 further comprises a switch 33 which provides a means to activate or deactivate the scratch-off mechanism 40 (also see FIG. 4). The switch 33 is located on a side surface of the upper panel 21 for illustration purposes only; it is known that other locations may be utilized without limiting the scope of the device 10. The switch 33 is preferably a conventional single-pole double-throw toggle switch, yet other switching devices may be utilized without limiting the scope of the device 10.

Figure 2:
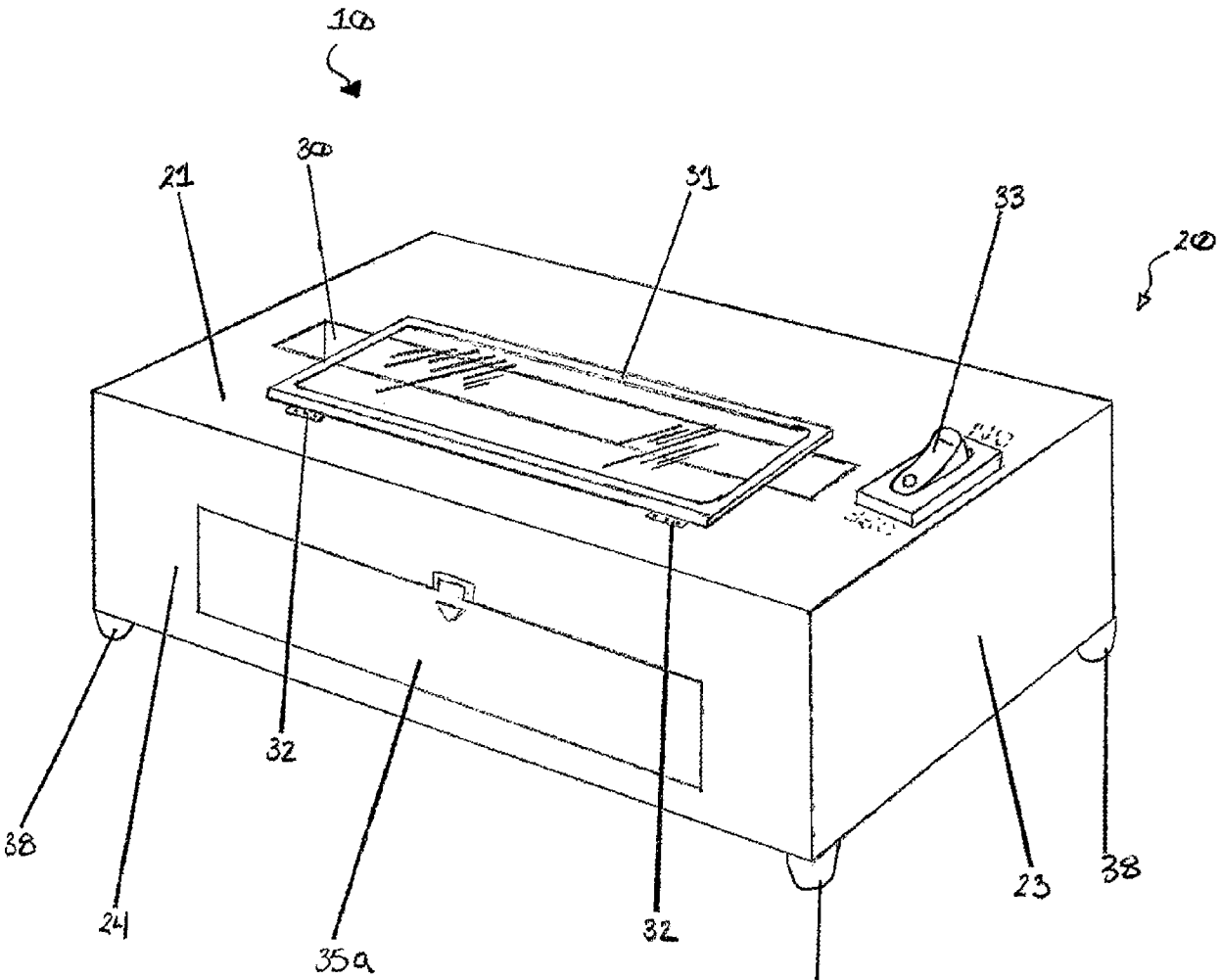
FIG. 2 is a rear perspective view of the automatic scratch-off material removal device 10, according to a preferred embodiment of the present invention.
Figure 3:
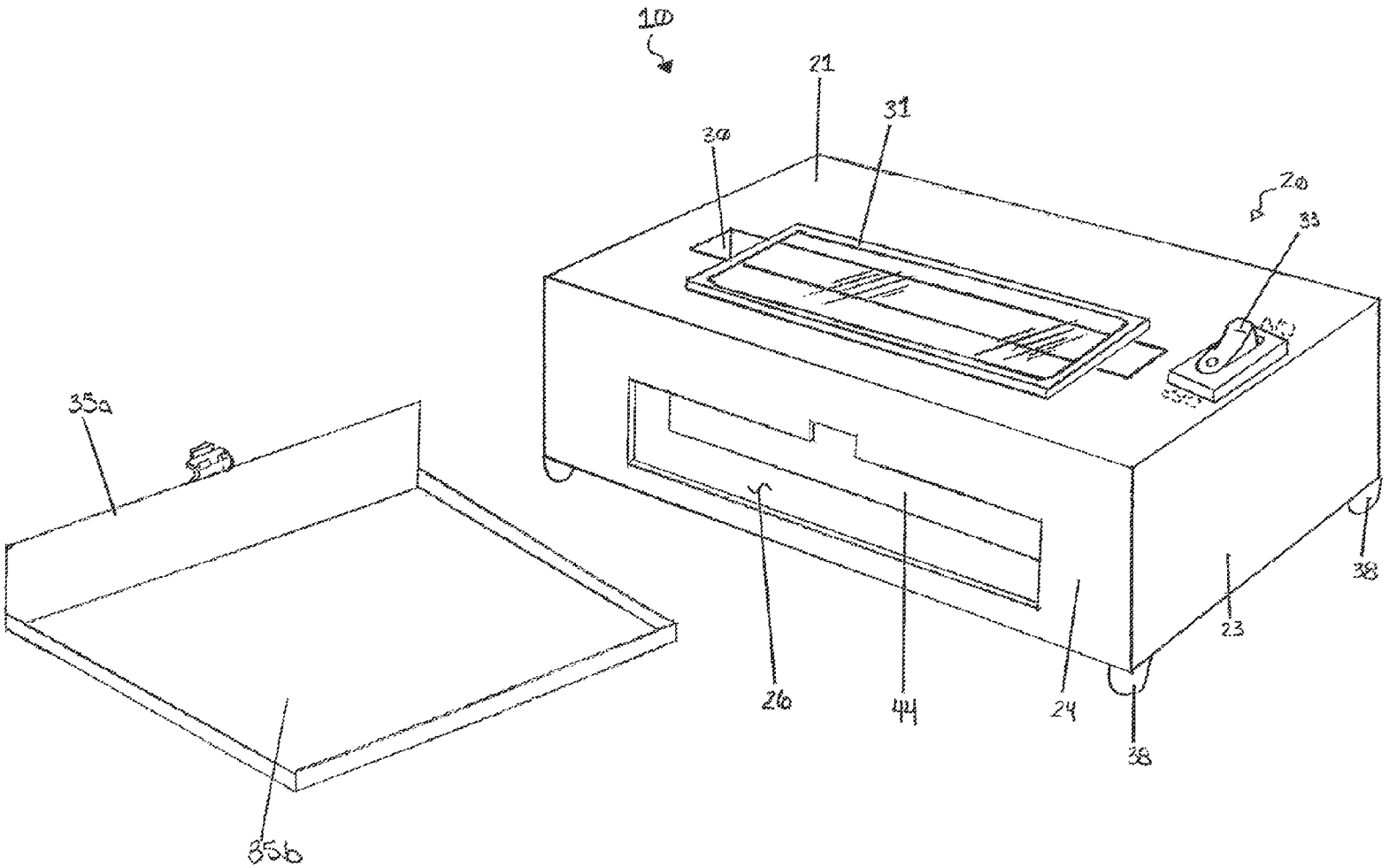
FIG. 3 is another rear perspective view of the automatic scratch-off material removal device 10 depicting a residue access compartment 35*a* removed, according to a preferred embodiment of the present invention.

Referring now to FIG. 2, a rear perspective view of the device 10 and FIG. 3, another rear perspective view of the device 10 depicting the residue access compartment 35*a* removed, according to the preferred embodiment of the present invention, are disclosed. The rear panel 24 of the enclosure 20 comprises a residue access compartment 35*a*. The residue access compartment 35*a* provides access to an interior portion 26 of the enclosure 20 to remove the coating residue that is collected after removal from the lottery ticket 15. The residue access compartment 35*a* comprises an open area into which the collection tray 35*b* is inserted to provide access to the interior portion 26 of the enclosure 20. The collection tray 35*b* further comprises a rear wall having a locking tab 34 which engages a perimeter notch 39 to secure the collection tray 35*b* within the access compartment 35*a*. The residue collection tray 35*b* includes a shallow reservoir platform 47 for the residue to accumulate. The residue collection tray 35*b* is removable from the access compartment 35*a* in order to access the reservoir platform 47 for disposing of the accumulated coating residue. The residue access compartment 35*a* is depicted as being located on an intermediate portion of the rear panel 24 for illustration purposes only; it is known that other locations may be utilized without limiting the scope of the device 10.

Referring now to FIG. 4, an underside perspective view of the device 10, according to the preferred embodiment of the present invention, is disclosed. The lower panel 25 on the device 10 comprises a battery compartment 36 and a plurality of feet 38. The battery compartment 36 provides a means to access the power supply for the device 10. The battery compartment 36 comprises a tab-locking panel which is removed in a revealing the internal portion. The battery compartment 36 is depicted as being located on the lower panel 25 for illustration purposes only; it is known that other locations may be utilized without limiting the scope of the device 10. The lower panel 25 also comprises a plurality of feet 38 which provide a stabilizing means to the device 10. The feet 38 are located on each corner of the lower panel 25 and are preferably fabricated from a non-skid rubber material, yet other materials may be utilized without limiting the scope of the device 10.

Figure 5:
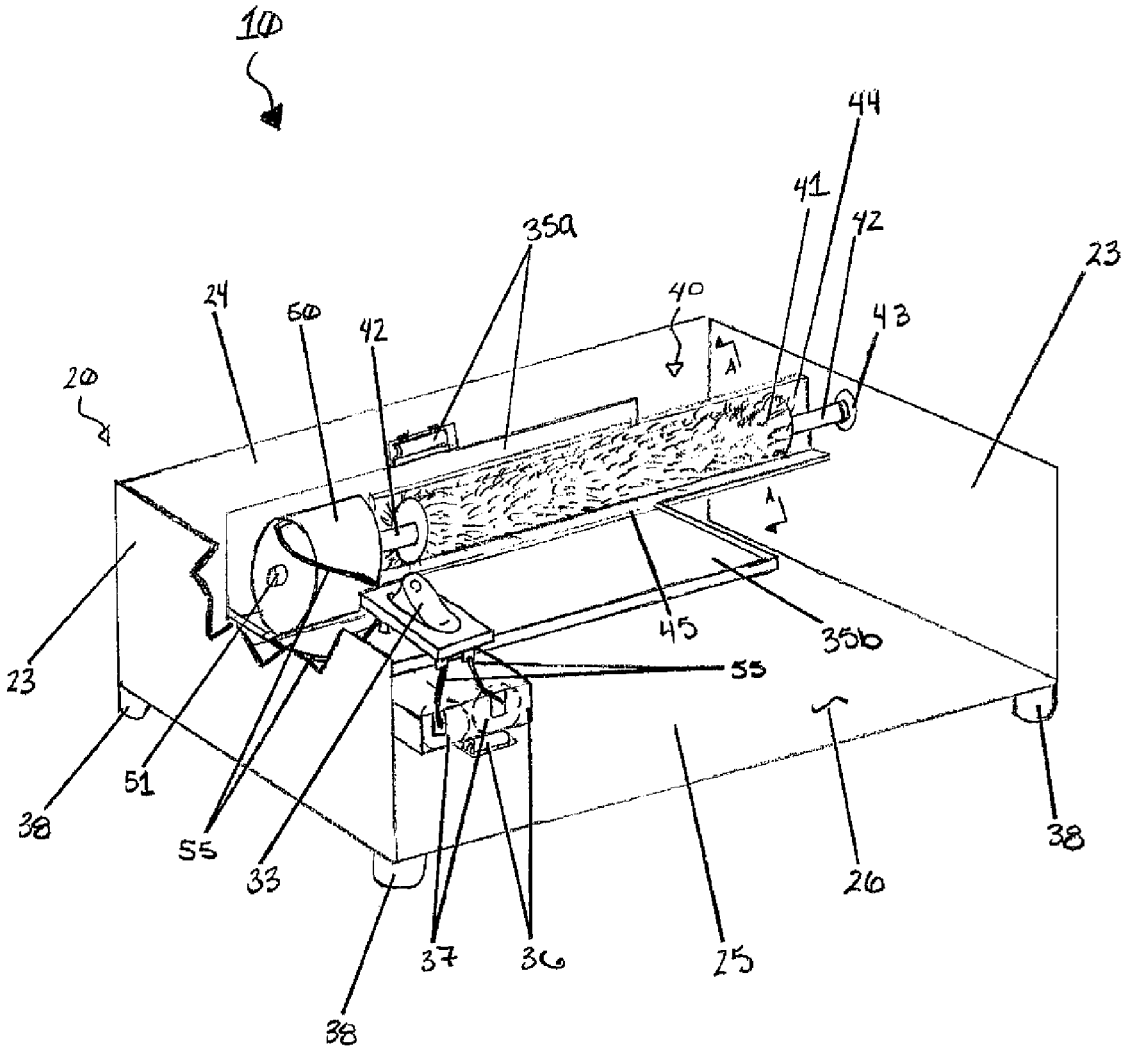
FIG. 5 is a break-away view of the automatic scratch-off material removal device 10, according to a preferred embodiment of the present invention.
Figure 6:
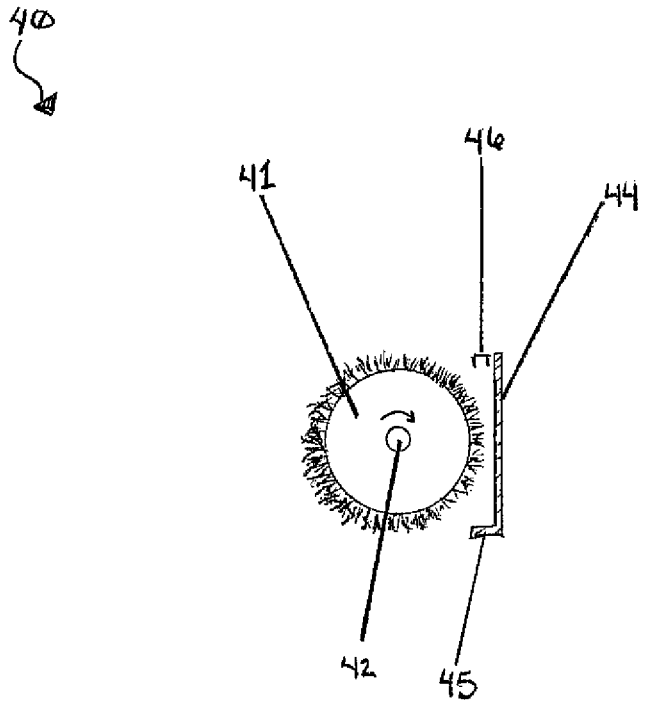
FIG. 6 is a section view of a scratch-off mechanism 40 of line A-A of FIG. 5, according to a preferred embodiment of the present invention; and, FIG. 7 is a block diagram depicting the major electrical components of the automatic scratch-off material removal device 10, according to a preferred embodiment of the present invention.
Figure 7:
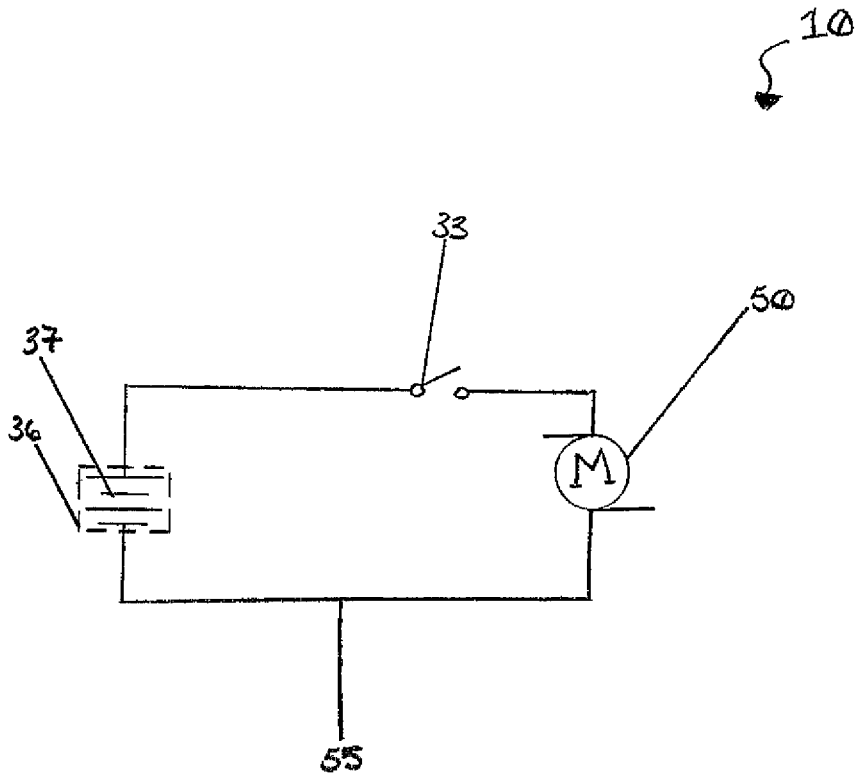

Referring now to FIG. 5, a break-away view of the device 10, FIG. 6, a section view of the scratch-off mechanism 40, and FIG. 7, a block diagram depicting the major electrical components of the device 10, according to the preferred embodiment of the present invention, are disclosed. FIG. 5 is depicted with the upper panel 21 and front panel 22 removed for illustration purposes only. The scratch-off mechanism 40 is positioned in a lateral orientation and comprises a brush 41, a guard 44, and a motor 50 which provides a means to remove the coating on lottery tickets 15. A proximal end of the brush 41 is mounted to a lateral side panel 23 by inserting a brush axle 42 into a brush cap 43. The brush cap 43 comprises a bushing member which is integrally molded into the side panel 23. The brush axle 42 is held within the brush cap 43 by an interference fitting. The brush axle 42 is positioned longitudinally through a central bore of the brush 41. The brush 41 comprises a plurality of bristles for brushing against the coating on the lottery ticket 15 for removal of the coating. The brush 41 is fabricated from materials which are suitable to remove the layer of substance coating, such as; plastic, wire, or similar semi-rigid materials. A distal end of the brush axle 42 rigidly engages a proximal end of a motor shaft 52 which is interconnected to the motor 50. The distal end of the motor shaft 52 is integrally molded and rotatably attached to an opposing lateral side panel 23 within a standard motor housing.

The guard 44 comprises a generally "L"-shaped member having a vertical base and a horizontal guard lip 45 extending perpendicularly from the lower end of the base. The guard lip 45 provides a support platform for a lottery ticket 15 to rest upon and limits the distance the lottery ticket 15 can be inserted into the interior portion 26 of the device 10 and aligns the face of the ticket with the surface bristles of the brush 43. The guard 44 is positioned adjacent to and behind the brush 41 in a parallel orientation with the guard lip 45 positioned below the brush 41. The guard 44 is preferably fabricated from materials such as plastic, metal or the like and attached to the upper panel 21 via adhesive, integral molding, or the like. A single lottery ticket 15 is inserted through the slot 30 and positioned within a gap 46 defined as the area between the brush 41 and the base of the guard 44. The lottery ticket 15 rests against the guard lip 45 and is in forced contact with the brush 41 which is rotated by the motor 50. The brush 41 presses against the surface of the lottery ticket 15, thereby incrementally removing the substance coating as the bristles scratch against the surface. The residue from the coating then falls onto and is collect within the collection tray 35*b* positioned below the scratch-off mechanism 40.

The motor 50 received power and control signals through electrical wiring 55 interconnected to the switch 33 and the batteries 37. The batteries 37 are preferably user replaceable electrochemical cells, yet other devices may be utilized without limiting the scope of the device 10. The switch 33 is depressable to close the circuit, thus sending current through the electrical wiring 55 to the motor 50. Once energized, the motor shaft 51 will rotate simultaneously rotating the brush 41.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of installing and utilizing the device 10 may be achieved by performing the following steps: acquiring the device 10; inserting batteries 37 into the battery compartment 36 as desired; positioning the device 10 on a level surface with the feet 38 resting upon the level surface; rotating the magnifying glass 31 to an upright position as desired to access the slot 30; inserting a lottery ticket 15 into the slot 30, thereby positioning the lottery ticket 15 into the gap 46 between the brush 41 and guard 44; resting the bottom surface of the lottery ticket 15 against the guard lip 45; depressing the switch 33 to activate the motor 50 and rotate the motor shaft 51 which simultaneously rotates the brush 41; enabling the brush 41 to remove the coating on the lottery ticket 15; enabling the coating residue to descend onto the collection tray 35*b*; deactivating the scratch-off mechanism 40 as desired via depressing the switch 33 as desired; removing the lottery ticket 15 from the slot 30 as desired to view the information; utilizing the device 10 as desired; and, allowing instant lottery players everywhere the ability to get increased enjoyment from their hobby in a manner which is quick, easy and effective.

The method of utilizing the magnifying glass 31 may be achieved by performing the following steps: acquiring the device 10; rotating the magnifying glass 31 to an upright position; positioning a lottery ticket 15 behind the magnifying glass 31 at a desired position; and, utilizing the magnifying glass 31 to read small print on the lottery ticket 15 as desired.

The method of cleaning the device 10 may be achieved by performing the following steps: acquiring the device 10; removing the residue access compartment 35*a* as desired to access the collection tray 35*b*; discarding of the collected coating residue from the collection tray 35*b*; inserting the collection tray 35*b* back into the residue access compartment 35*a*; and, repeating as necessary.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An automatic scratch-off material removal device for a scratchcard game piece, said device comprising:

an enclosure having a generally rectangular body defining an interior, further comprising an upper panel, a lower panel, a front panel, a rear panel, a first lateral side panel and a second lateral side panel;

an elongated slot longitudinally disposed along a central position in said upper panel for insertingly receiving said game piece and for providing access to said interior portion;

a brush assembly rotatably mounted within said enclosure adjacent to said slot for removal of scratch-off material;

a motor attached within said enclosure and connected to said brush assembly for rotating said brush assembly;

a guard attached within said enclosure adjacent to said brush for supporting said game piece;

a collection tray removably inserted within said enclosure for collecting said scratch-off material;

a magnifying lens hingedly attached to said upper panel adjacent to said slot, capable of being hingedly closed thereby covering said slot and being hingedly open for providing a magnified image of said game piece;

a powering means in electrical communication with said motor for providing a supply of power to said motor; and, a switch mounted to an exterior of said enclosure being in electrical communication between said powering means and said motor for controlling said supply of power.

2. The device of claim 1, wherein said motor further comprises a motor housing affixed to said second lateral side panels and a motor shaft extending from said motor;

wherein said motor shaft is rigidly connected to said brush assembly.

3. The device of claim 1, wherein said brush assembly further comprises:

an elongated cylindrical brush body having a plurality of rigid bristles radially extending from said brush body; and, a brush axle longitudinally disposed through a center of said brush body having a proximal end protruding from an end of said brush body and a distal end protruding from an opposing end of said brush body;

wherein said brush axle proximal end is rotatingly attached to first lateral side panel and said brush axle distal end is rigidly connected to said motor; and, wherein said first lateral side panel further comprises a bushing to receive said brush axle proximal end and provide a bearing surface for rotation of said brush axle.

4. The device of claim 1, wherein said enclosure further comprises an access compartment disposed on said rear panel for insertingly receiving said collection tray.

5. The device of claim 4, wherein said collection tray further comprises:

a rear wall suitably sized to cover said access compartment; and, a reservoir platform extending perpendicularly from a bottom end of said rear wall for collecting said scratch-off material;

wherein said reservoir platform is positioned below said brush assembly and said guard.

6. The device of claim 5, wherein said access compartment further comprises a notch disposed on a perimeter edge; and, wherein said collection tray further comprises a locking tab disposed on an upper end of said rear wall;

whereby said locking tab removably engages said notch to secure said collection tray within said access compartment.

7. The device of claim 1, wherein said powering means further comprises at least one battery; and, wherein said enclosure further comprises a battery compartment disposed in said lower panel for storing said at least one battery and a cover removably attached to said battery compartment.

8. The device of claim 1, wherein said enclosure further comprises a foot affixed to each perimeter corner of said lower panel for providing a means of stabilizing said enclosure.

9. The device of claim 1, wherein said guard further comprises a generally L-shaped member affixed between said first and said second lateral side panel adjacent to said brush assembly;

wherein said guard further comprises a vertical base and a horizontal lip extending perpendicularly from a lower end of said base;

wherein a gap is defined between said brush body and said base for receiving said game piece and positioning said game piece in forced contact with said plurality of bristles; and, wherein said lip provides a support for said game piece to rest upon.

10. The device of claim 1, wherein said switch further comprises a first position for distributing said supply of power and activating said motor and a second position for restricting said supply of power and deactivating said motor.

11. An automatic scratch-off material removal device for scratchcard game piece, said device comprising:

an enclosure comprising a generally rectangular form having an upper panel, a lower panel, a front panel, a rear panel, a first lateral side panel and a second lateral side panel, said enclosure defining an interior portion;

an elongated slot longitudinally disposed along a central position in said upper panel for insertingly receiving said game piece and for providing access to said interior portion;

an elongated cylindrical brush body having a plurality of rigid bristles radially extending from said brush body, said brush body is adjacent to said slot for removal of scratch-off material;

a brush axle longitudinally disposed through a center of said brush body having a proximal end protruding from an end of said brush body and a distal end protruding from an opposing end of said brush body, wherein said first lateral side panel further comprises a bushing to rotatingly receive said brush axle proximal end for providing a bearing surface for rotation of said brush axle;

a motor comprising a motor housing affixed said second lateral side panel and a motor shaft extending from said motor, said motor shaft rigidly connected to said brush axle distal end for rotating said brush body;

a guard comprising a vertical base and a horizontal lip extending perpendicularly from a lower end of said base affixed between said first and said second lateral side panel, said guard disposed adjacent to said brush body for supporting said game piece;

a gap defined between said brush body and said base for receiving said game piece and positioning said game piece in forced contact with said plurality of bristles;

a collection tray insertably connected within said enclosure disposed below said brush body, said collection tray further comprising a reservoir platform for collecting said scratch-off material;

a magnifying lens hingedly attached to said upper panel adjacent to said slot, capable of being hingedly closed thereby covering said slot and being hingedly open for providing a magnified image of said game piece;

a powering means in electrical communication with said motor for providing a supply of power to said motor; and, a switch mounted to an exterior of said enclosure being in electrical communication between said powering means, said switch comprising a first position for distributing said supply of power and activating said motor and a second position for restricting said supply of power and deactivating said motor.

12. The device of claim 11, wherein said enclosure further comprises an access compartment disposed on said rear panel for insertingly receiving said collection tray;

wherein said collection tray further comprises a rear wall suitably sized to cover said access compartment;

wherein said access compartment further comprises a notch disposed on a perimeter edge; and, wherein said collection tray further comprises a locking tab disposed on an upper end of said rear wall;

whereby said locking tab removably engages said notch to secure said collection tray within said access compartment.

13. The device of claim 11, wherein said powering means further comprises at least one battery;

wherein said enclosure further comprises a battery compartment disposed in said lower panel for storing said at least one battery and a cover removably attached to said battery compartment.

14. The device of claim 11, wherein the device further comprises a magnifying lens hingedly attached to said upper panel adjacent to said slot, said magnifying lens capable of being hingedly closed thereby covering said slot and capable of being hingedly open for providing a magnified image of said game piece;

wherein said powering means further comprises at least one battery;

wherein said enclosure further comprises an access compartment disposed on said rear panel for insertingly receiving said collection tray and a battery compartment disposed in said lower panel for storing said at least one battery and a cover removably attached to said battery compartment;

wherein said collection tray further comprises a rear wall suitably sized to cover said access compartment; and, wherein said access compartment further comprises a notch disposed on a perimeter edge and said collection tray further comprises a locking tab disposed on an upper end of said rear wall, whereby said locking tab removably engages said notch to secure said collection tray within said access compartment.

15. The device of claim 14, wherein said enclosure further comprises a foot affixed to each perimeter corner of said lower panel for providing a means of stabilizing said enclosure.

16. The device of claim 14, wherein said enclosure further comprises a foot affixed to each perimeter corner of said lower panel for providing a means of stabilizing said enclosure; and, wherein said enclosure further comprises a length of approximately ten inches, a width of approximately five inches, and a height of approximately two and one-half inches.

* * * * *